United States Patent [19]

Gross

[11] Patent Number: 4,716,671

[45] Date of Patent: Jan. 5, 1988

[54] ADVERTISING COVER FOR FLUORESCENT LIGHTING

[76] Inventor: Jan S. Gross, 315 Garden La., Atlantic Beach, Fla. 32233

[21] Appl. No.: 864,548

[22] Filed: May 19, 1986

[51] Int. Cl.[4] ..... G09F 13/00

[52] U.S. Cl. ..... 40/558; 40/10 D; 40/600

[58] Field of Search ..... 40/10 B, 10 D, 124, 40/124.1, 152, 152.1, 558, 592, 600, 10 R

[56] References Cited

U.S. PATENT DOCUMENTS

| | | | |
|---|---|---|---|
| 3,449,848 | 6/1969 | Howell | 40/605 |
| 3,525,461 | 8/1970 | Bronson | 224/315 |
| 3,789,530 | 2/1974 | Brooks et al. | 40/124 |
| 3,936,967 | 2/1976 | Davis | 40/129 C |
| 3,952,437 | 4/1976 | Mitchell | 40/152.1 |
| 3,984,931 | 10/1976 | Belokin, Jr. | 40/130 C |
| 4,052,806 | 10/1977 | George | 40/129 C |
| 4,300,299 | 11/1981 | Batky | 40/607 |
| 4,608,773 | 9/1986 | White | 40/606 |

FOREIGN PATENT DOCUMENTS

| | | | |
|---|---|---|---|
| 2733754 | 2/1979 | Fed. Rep. of Germany | 40/558 |
| 306503 | 3/1933 | Italy | 40/592 |

*Primary Examiner*—John E. Murtagh
*Assistant Examiner*—Andrew Joseph Rudy
*Attorney, Agent, or Firm*—Arthur G. Yeager; Earl L. Tyner

[57] ABSTRACT

Decorative advertising cover for overhead fluorescent strip lighting, the cover having the general shape of a triangular prism, the cover including a rectangular sheet of flexible transparent plastic having two opposite sides slidingly engaged in channel recesses in two opaque triangular end caps having a top edge to fit closely adjacent a ceiling to which the fluorescent strip lighting is attached and two side edges joined in a rounded corner opposite to the top edge, a cutout portion in the central portion of the top edge and extending downwardly to fit closely adjacent the outside perimeter of the fluorescent strip lighting fixture, laterally slideable finger means to engage the upper side of the fluorescent lighting fixture to support the cover, laterally movable magnet means mounted on opposite sides of the cutout portion to fasten themselves to the raceway of the fluorescent strip lighting fixture by magnetic attraction, parallel lengths of two pairs of spaced sheet edge engaging clips attached to the inside of the flexible transparent sheet adapted to receive a translucent film panel with advertising thereon, the clips adapted to hold said panels on two sides of the prism, and decorative tapes attached to the outside of the sheet to hide said clips from view.

14 Claims, 9 Drawing Figures

ADVERTISING COVER FOR FLUORESCENT LIGHTING

BACKGROUND OF THE INVENTION

Advertising material is displayed inside sales rooms in retail stores and markets in a variety of ways. One of the most desirable procedures is to use a lighted sign because of its eye-catching capabilities. Generally, however, such lighted signs are specially designed items, separate from the illumination for the room, and somewhat expensive to purchase, install, and maintain. The use of the illumination lighting for advertising purposes has not been considered practical because the reduced illumination in the room was not acceptable. Nevertheless, the possibility of using the illumination lighting for advertising in a low cost acceptable manner has remained in the minds of marketing people as a desirable solution to some of their needs.

It is an object of this invention to provide a novel advertising cover for fluorescent strip lighting. It is another object of this invention to provide a light weight, inexpensive, attractive partially transparent structure to cover overhead fluorescent lamps and provide advertising space without materially detracting from the illumination provided by the lamps. Still other objects will become apparent from the more detailed description which follows.

BRIEF SUMMARY OF THE INVENTION

This invention relates to an advertising cover for fluorescent strip lighting comprising a pair of triangular end caps and a flexible transparent sheet of plastic, each said end cap having an inside and an outside, a top edge and two side edges each joined to opposite ends of said top edge and to each other in a smoothly rounded corner to assume the general shape of a triangle, a generally rectangular cutout portion extending from the central portion of the top edge toward said rounded corner, said two side edges and said top edge having a right angle flange portion extending inwardly from said inside surface, channel recess extending the entire length of said side edges and said rounded corner, a pair of extendable-retractable fingers mounted opposite to each other adjacent said top edge and adapted to extend said fingers toward each other along the top edge of said cutout portion, a pair of extendable-retractable magnets mounted on opposite vertical sides of said cutout portion and adapted to be magnetically attractively attached to opposite sides of the metallic fluorescent strip lighting raceway; said flexible transparent plastic sheet having an inside surface and an outside surface and being of a size to slide in said channel recesses of said end caps, a pair of parallel sheet receiving elongated clips extending across the inside surface of said plastic sheet from one end cap to the other end cap adjacent the juncture of said rounded corner and said side edges, a plurality of spaced sheet receiving clip sections extending in an interrupted line across the inside surface of said plastic sheet adjacent said top edge, and a pair of sheet receiving clip sections attached to said end cap adjacent said channel recess, said clips being positioned to receive four sides of each of two sheets of translucent film containing advertising material; and four lengths of decorative opaque tape attached to said outside surface of said transparent plastic sheet so as to hide from view said clips attached to said transparent plastic sheet.

In preferred embodiments of this invention the end caps and the transparent plastic sheet are adhesively bonded together to make a single unitary structure which can be attached anywhere along the length of fluorescent strip lighting by finger supports extending between the raceway and the ceiling and by magnet supports magnetically attaching themselves to the sides of the metallic raceway.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 8:
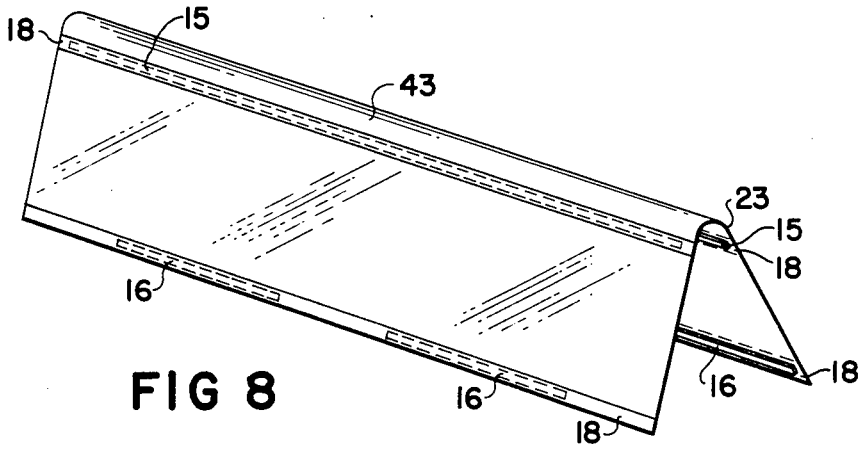
FIG. 8 is a perspective view of the plastic sheet used in this invention.

In FIGS. 1-4 of the attached drawings there are shown views of the cover of this invention indicating how it is used. The invention is a generally transparent cover in the form of a triangular prism which can be hung from an overhead fluorescent lighting fixture and provide advertising space backlighted by the light from the fixture. The cover has three parts; namely, a transparent plastic sheet 11 joined to two end caps 10 to form a triangular prism shape having two sides covered by the plastic sheet 11 and the top side open to fit over the raceway 12 of fluorescent strip lighting having one or more tubular lamps 13 hanging below raceway 12. Normally such a fixture is attached to the ceiling 40 of a room to be illuminated by the light. End caps 10 may be transparent or opaque and are stiff inflexible structures which support a single piece of flexible plastic sheeting 11 in a channel recess 17 running around the outside of the two side edges 22 of end caps 10. Top edge 21 of end caps 10 is in close proximity to ceiling 40 and with sheet 11 terminating adjacent the ends of top edge 21, the entire top side of the triangular prism shape is open. This permits the cover to be easily placed over any selected portion of fluorescent strip lighting and allow room for heat from the lighting to flow out between ceiling 40 and the top edges of sheet 11. The channel recess 17 extends from the top of one side edge 22 of end cap 10 to the top of the other side edge 22 in a continuous manner including rounded corner 23 where the two side edges 22 meet. This permits a single sheet 11 to be used with two end caps 10. Preferably, these three components are affixed to each other by a suitable adhesive applied to channel 17 in each end cap 10. A preferred material for end caps 10 is an injection moldable, fire-retardant ABS resin. Transparent sheet 11 preferably is a polyester about 90–100 mils in thickness. Preferably, sheet 11 is thermoformed into its final V-shape as shown in FIG. 8 before being assembled to end caps 10 and adhesively affixed thereto. With such materials silicone adhesive functions well to connect them together. Other suitable materials may be employed for these component parts and for the adhesive. When placed in position over the fluorescent strip lighting raceway 12, the cover has a top portion 42 and a bottom portion 41 as viewed by an observer in the room where the cover is used.

When assembled, each end cap 10 has an outside surface 36 and an inside surface 37; and plastic sheet 11 has an outside surface 38 and an inside surface 39. In order to provide a means to attach two advertising panels 14 to the structure, there are two pairs of clips attached to the inside surface 39 and a pair of clips to the inside of each end cap 10 so that the two panels may be slidingly engaged into the cover and be manually removable when desired. A single length of a U-shaped clip 15 extends across sheet 11 near bottom 41 of the cover, and a plurality of spaced short lengths of clips 16 extend across sheet 11 near top 42 of the cover. Spaces between clips 16 are left to provide access to the top edge of panel 14 for ease of manual insertion or removal of panel 14. Panel 14 normally will be a translucent film with printing thereon so as to permit as much as possible of the illumination from fluorescent lamps 13 to pass through the cover.

Figure 9:
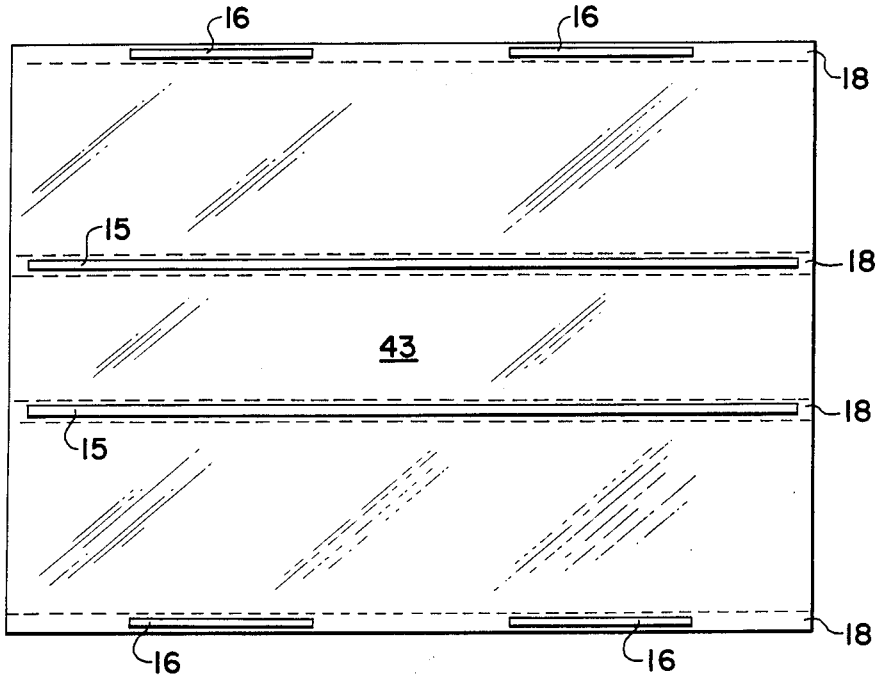
FIG. 9 is a top plan view of the inside of the plastic sheet before being formed.

On outside surface 38 of sheet 11 is a decorative tape 18 or a strip of opaque paint for each of clips 15 and 16 to hide clips 15 and 16 from view. Between the two bottom tapes or strips 18 is a clear unobstructed portion 43 of sheet 11 immediately below lamps 13 so that the direct downward illumination will not be impaired. This is of advantage because the fluorescent strip lighting fixture is normally hung over a display stand or shelf in a store and portion 43 permits full illumination of the products displayed below the cover. A view of sheet 11 with clips 15 and 16 and tapes 18 attached is shown in FIG. 9. The flat assembly of FIG. 9 is then heated to its thermoforming temperature and allowed to cool into the V-shape of FIG. 8, and it is then ready for assembly and attachment to two end caps 10.

Figure 1:
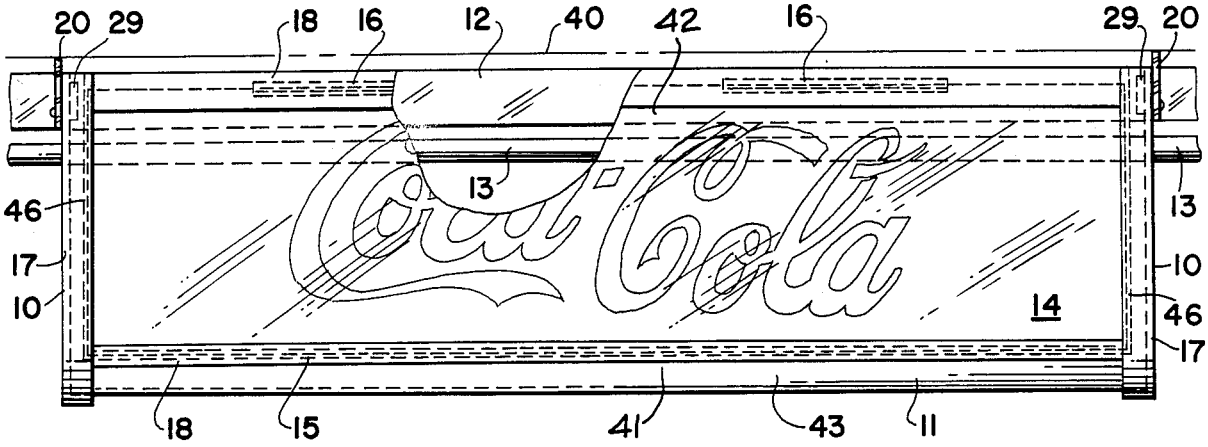
FIG. 1 is a front elevational view of the cover of this invention attached to an overhead fluorescent lighting fixture.
Figure 2:
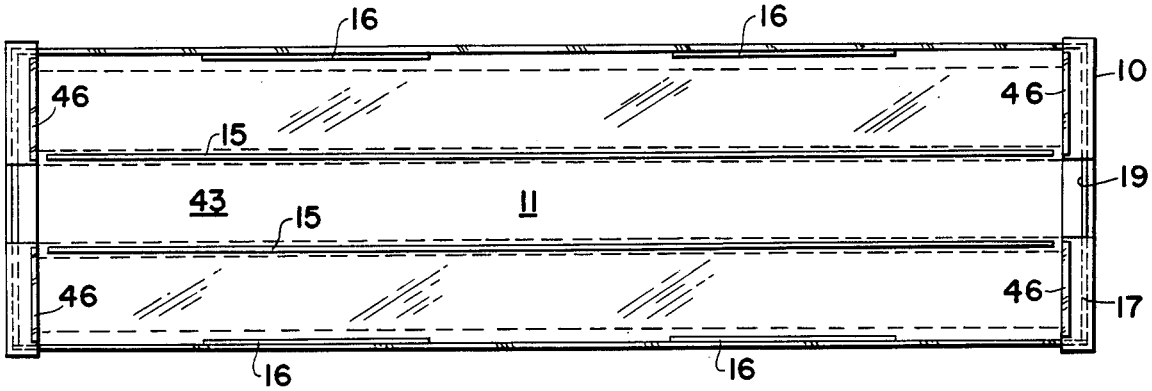
FIG. 2 is a top plan view of the cover of this invention.
Figure 3:
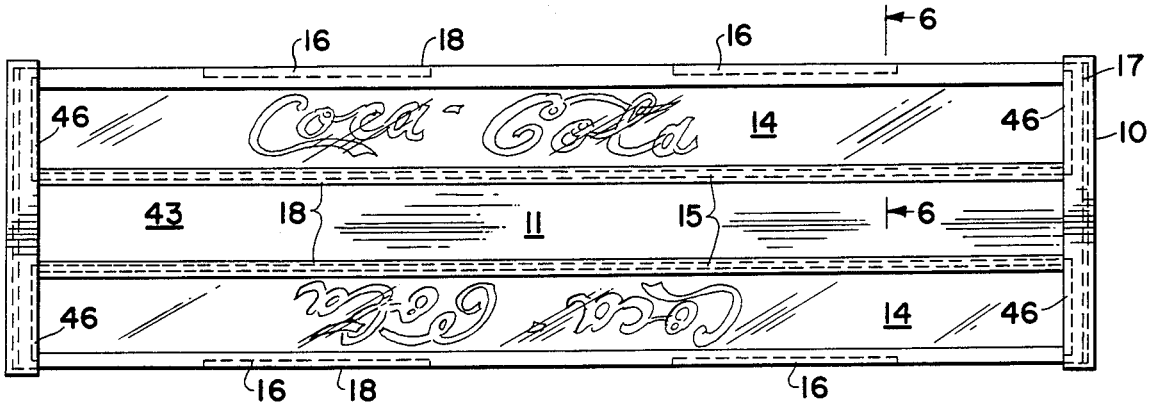
FIG. 3 is a bottom plan view of the cover of this invention.
Figure 4:
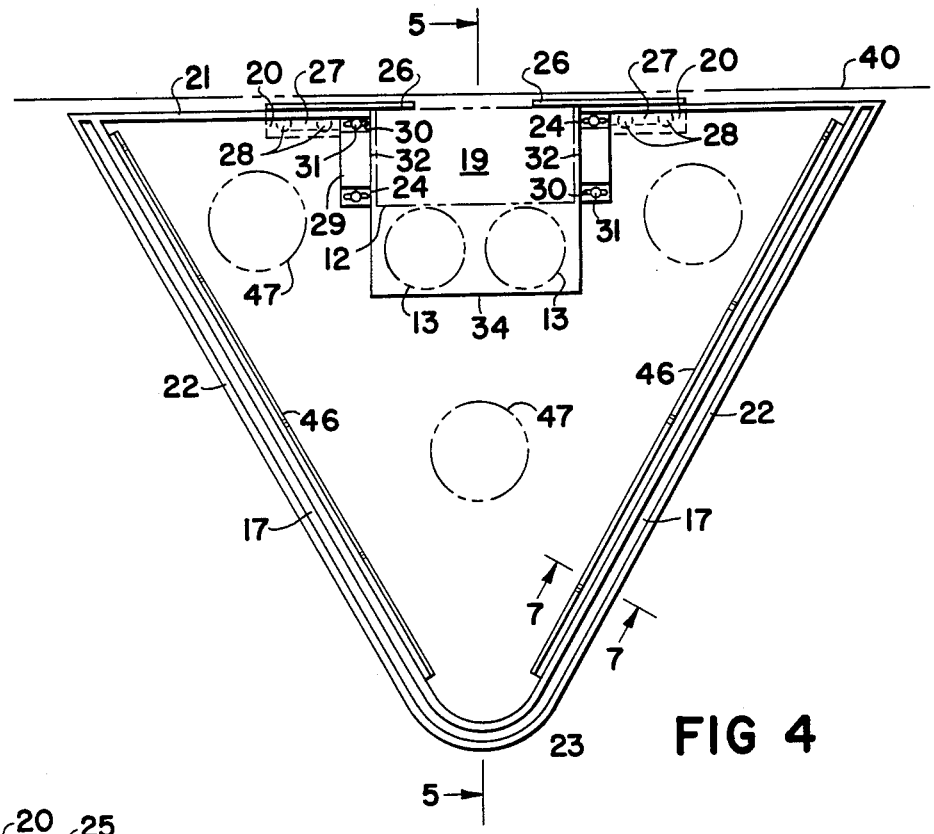
FIG. 4 is an inside elevational view of an end cap of the cover of this invention.
Figure 5:
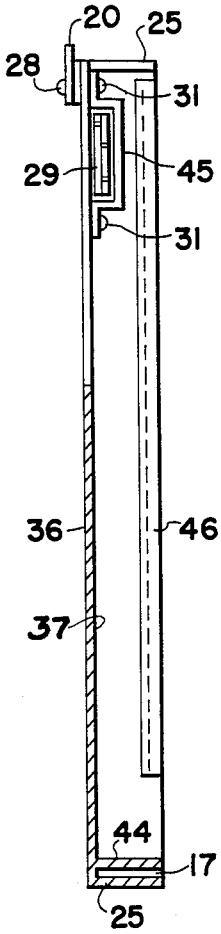
FIG. 5 is a cross sectional view taken at 5—5 of FIG. 4.

In FIGS. 4 and 5 the details of end caps 10 are best illustrated. The general shape of cap 10 is triangular with a top edge 21 and two side edges 22 meeting in a rounded corner 23. The triangular shape shown is equilateral, although other shapes are contemplated, such as an isosceles triangle, triangles with unequal sides, trapezoidal, rectangular, semicircular, and the like. Extending around all edges 21 and 22 is an internally directed flange 25 to provide for stiffness and to function as one side of channel recess 17. The inner wall 44 forms the other side of channel recess 17 which serves as a receiver for the lateral edges of transparent plastic sheet 11. Inner wall 44 extends from one end of top edge 21 along both side edges 22 and through rounded corner 23 to the other end of top edge 21. Thus channel recess 17 is not present across any of top edge 21 although flange 25 does extend across top edge 21. In the central portion of top edge 21 is a cutout section 19 approximating the cross section shape of fluorescent strip lighting raceway 12 and lamps 13. That cross-section normally is rectangular as shown at 34. Along inner wall 44 on side edges 22 are two lengths of sheet receiving clips 46 identical to clips 15 and 16 described above. Clips 46 are adapted to receive the lateral edges of translucent film panel 14 to keep it flat and to prevent buckling during use. Clips 46 are adhesively secured to end cap 10.

In order to provide means for supporting the cover from the fluorescent strip lighting two types of attachment devices are provided to engage raceway 12. Along top edge 21 at the corners of cutout section 19 on outside surface 36 there are mounted an opposing pair of slidable finger means 20. Each finger means has a slender finger 26 attached to a body with a slot 27 which is slidably confined by pins 28 to permit finger 26 to slide horizontally within the limits provided by slots 27 and pins 28. Finger 26 is adapted to slide over the top of raceway 12 shown in FIG. 4. Normally there is sufficient space between ceiling 40 and the top of raceway 12 to permit slender finger 26 to be inserted. For every cover there will be four such fingers, which is more than adequate to support the light weight cover of this invention (normally less than one pound). As a supplement or an alternate to the finger means 20 there are provided four magnet means 29. Each end cap 10 has a pair of magnet means 29 attached on opposing sides of cutout section 19 along the vertical edges 24 of section 19. Each magnet means 29 includes a housing 45 having slots 30 mounted horizontally over pins 31 so as to provide a small horizontal travel for the magnet in housing 45. Inside housing 45 is a permanent magnet with a face 32 available to attach itself to a metallic wall of fluorescent strip lighting raceway 12. Magnet means 29 are slidingly mounted on pins 31 so that upon positioning end caps 10 over base 12, magnet faces 32 will automatically slide laterally to attach themselves to the vertical walls of raceway 12. Because of the light weight of the cover, four magnet means 29 are more than adequate to support the cover by themselves. Nevertheless, for safety reasons it is preferred to employ four finger means 20 and four magnet means 29 for each cover. Magnet means 29 are mounted on inside surface 37 to hide them from view, although it is to be understood that they may instead be mounted on outside surface 36. Both finger means 20 and magnet means 29 may be attached to end cap 10 by any convenient method of attachment, such as blind rivets, regular rivets, adhesives, or the like. There also are shown on FIG. 4, ventilation passageways 47 which may be included in end cap 10 if desired. Any number and any size of passageways 47 may be employed for ventilation and removal of heat from lamps 13.

Figure 6:
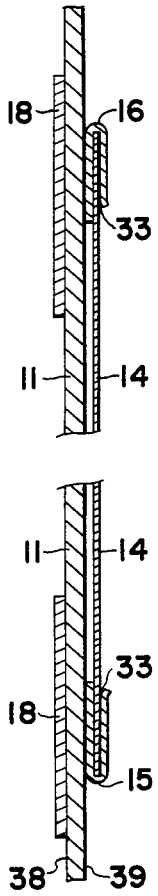
FIG. 6 is a cross sectional veiw taken at 6—6 of FIG. 3.
Figure 7:
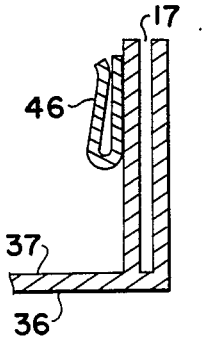
FIG. 7 is a cross sectional view taken at 7—7 of FIG. 4.

FIG. 6 shows an enlarged view of how clips 15 and 16 are positioned on sheet 11 and how they hold panel 14. Clips 15 and 16 are U-shaped in cross section usually with the mouth 33 of the clips made small and inherently spring biased by reason of the original manufacture of the clip to fit tightly against any film panel 14 inserted into mouth 33 of the clip. Lateral edges of panel 14 will similarly slide into clips 46 on end caps 10 so that the final result will be to contain all four edges of each panel 14. Clips 15 and 16 are adhesively affixed to the inside surface 39 of sheet 11 and over a length which will not interfere with the assembly of sheet 11 into channel recess 17 of each end cap 10. On outside surface 38 of sheet 11 opposite to the position of clips 15 and 16 there is a tape or strip 18 applied to hide clips 15 and 16 from view. This may be a plastic or fabric tape applied adhesively to outside surface 38 or a strip of paint or other opaque ink applied to surface 38.

It is to be noted that the cover of this invention is especially adapted to be attached to fluorescent strip lighting now popular in retail stores where goods are displayed on shelves along aisles where customers view the goods. The cover may readily be attached any place along the strip lighting without the necessity of any tools and without need for any special lighting or support. The cover, after being attached to the strip lighting may be slid along to any location. In this manner the raceway functions as a track over which the cover may be moved from place to place much in the same way that the light fixtures in track lighting may be moved. Either or both of the finger supports 20 or the magnet supports 29 hold the cover in attachment to the raceway while the cover is slidingly moved from place to place. The cover of this invention is adaptable to receive different advertising panels which can be inserted and removed from the cover easily. Furthermore, because this cover does not have any lighting of its own, it is not necessary to be tested for safety codes of the state where installed.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. An advertising cover for a fluorescent strip lighting fixture including a raceway and one or more tubular fluorescent light lamps comprising a pair of triangular end caps and a flexible transparent sheet of plastic, each said end caps and a flexible transparent sheet of plastic, each said end cap having an inside and an outside, a top edge and two side edges each joined to opposite ends of said top edge and to each other in a smoothly rounded corner, a generally rectangular cutout portion extending from middle of the top edge toward said rounded corner, said two side edges and said top edge having a right angle flange portion extending inwardly from said inside surface, a channel recess adjacent said flange portion along said side edges and said rounded corner, a pair of extendable-retractable fingers mounted opposite to each other adjacent said top edge and adapted to extend said fingers toward each other along the top edge of said cutout portion, a pair of extendable-retractable magnets mounted on opposite vertical sides of said cutout portion and adapted to be magnetically attractively attachable to opposite sides of said fluorescent lighting raceway; said flexible transparent plastic sheet having an inside surface and an outside surface and being of a size to slide in said channel recess of each of said end caps, a pair of parallel sheet receiving elongated clips extending across the inside surface of said plastic sheet from one end cap to the other end cap adjacent said rounded corner and said side edges, a plurality of spaced sheet receiving clip sections extending in an interrupted line across the inside surface of said plastic sheet adjacent said top edge, and a pair of sheet receiving clip sections attached to said end cap adjacent said channel recess, said clips being positioned to receive four sides of each of two sheets of translucent film containing advertising material; and four lengths of decorative opaque tape attached to said outside surface of said transparent plastic sheet so as to hide from view said clips attached to said transparent plastic sheet.

2. The cover of claim 1 wherein said end caps and said flexible transparent sheet of plastic are adhesively bonded to each other along said channel recesses to make a unitary cover adapted to receive removable sheets of advertising material manually engageable on respective pairs of said clips.

3. The cover of claim 1 wherein said fingers are adapted to extend inwardly over the top of said fluorescent strip lighting raceway and to support said cover thereby.

4. The cover of claim 1 wherein said magnets are of sufficient strength and size to support said cover and translucent film advertising sheets.

5. The cover of claim 1 wherein said cutout portion is slightly larger than the cross section of the fluorescent strip lighting raceway and lamps to which it is attachable.

6. The cover of claim 1 wherein the bottom of said cover extending between said respective rounded corners is transparent.

7. A combination of a continuous length of fluorescent strip lighting fixture, mounted on the ceiling of a room and including a raceway and one or more tubular fluorescent light lamps, and an advertising cover adapted to be attached to said strip lighting fixture an any selected location, said cover comprising a pair of triangular end caps and a flexible transparent sheet of plastic, each said end cap having an inside and an outside, a top edge and two side edges each joined to opposite ends of said top edge and to each other in a smoothly rounded corner, a generally rectangular cutout portion extending from the middle of the top edge toward said rounded corner, said two side edges and said top edge having a right angle flange portion extending inwardly from said inside surface, a channel recess adjacent said flange portion along said side edges and said rounded corner, a pair of extendable-retractable fingers mounted opposite to each other adjacent said top edge and adapted to extend said fingers toward each other adjacent said top edge and adapted to extend said fingers toward each other along the top edge of said cutout portion, a pair of extendable-retractable magnets mounted on opposite vertical side of said cutout portion and adapted to be magnetically attractively attachable to opposite side of said fluorescent strip lighting raceway; said flexible transparent plastic sheet having an inside surface and an outside surface and being of a size to slide in said channel recess of each of said end caps, a pair of parallel sheet receiving elongated clips extending across the inside surface of said plastic sheet from one end cap to the other end cap adjacent said rounded corner and said side edges, a plurality of spaced sheet receiving clip sections extending in an interrupted line across the inside surface of said plastic sheet adjacent said top edge, and a pair of sheet receiving clip sections attached to said end cap adjacent said channel recess, said clips being positioned to receive four sides of each of two sheets of translucent film containing advertising material; and four lengths of decorative opaque tape attached to said outside surface of said transparent plastic sheet so as to hide from view said clips attached to said transparent plastic sheet.

8. The combination of claim 7 wherein said end caps and said flexible transparent sheet of plastic are adhesively bonded to each other along said channel recesses to make a unitary cover adapted to receive removable sheets of advertising material manually engageably on respective pairs of said clips.

9. The combination of claim 7 wherein said fingers are adapted to extend inwardly over the top of said fluorescent strip lighting raceway and to support said cover thereby.

10. The combination of claim 7 wherein said magnets are of sufficient strength and size to support said cover and translucent film advertising sheets.

11. The combination of claim 7 wherein said cutout portion is slightly larger than the cross section of the fluorescent strip lighting raceway and lamps to which it is attachable.

12. The combination of claim 7 wherein the bottom of said cover extending between said respective rounded corners is transparent.

13. The combination of claim 9 wherein said cover, with said fingers extended over the top of said raceway, is slidable along said raceway while being continuously supported by said fingers.

14. The combination of claim 10 wherein said cover, with said magnets attached to said raceway, is slidable along said raceway while being continuously supported by said magnets.

* * * * *